United States Patent [19]

Keifer

[11] Patent Number: 4,598,827

[45] Date of Patent: Jul. 8, 1986

[54] VERSATILE GARMENT SECURITY DEVICE

[76] Inventor: Terry A. Keifer, 20B Congressional Cir., Flying Hills, Reading, Pa. 19607

[21] Appl. No.: 691,072

[22] Filed: Jan. 14, 1985

[51] Int. Cl.[4] ..... A47F 7/19

[52] U.S. Cl. ..... 211/4; 70/59

[58] Field of Search ..... 211/4, 7; 70/58, 18, 70/59, 60, 62

[56] References Cited

U.S. PATENT DOCUMENTS

| | | | |
|---|---|---|---|
| 4,069,691 | 1/1978 | Simpson | 70/59 |
| 4,212,175 | 7/1980 | Zakow | 70/58 |
| 4,260,063 | 4/1981 | Bennett et al. | 211/4 |
| 4,460,093 | 7/1984 | Otema | 211/4 |

*Primary Examiner*—Robert W. Gibson, Jr.
*Attorney, Agent, or Firm*—Eugene E. Renz, Jr.

[57] ABSTRACT

A system for securing display items to a fixture or the like comprising a housing adapted to be secured to the fixture, a plurality of elongated cables for securing the display items to the fixture, each cable having means at one end securing it to the display item and detachably secured in the housing at its opposite end, means defining cable retention and release channel means in said housing for a plurality of said cables, said channel means having an enlarged entrance portion and being of a configuration to permit insertion and removal of said opposite end of any one of said cables whereby any one of said cables may be inserted or removed individually and locking means actuatable between a position blocking said entrance portion of said channel means and a second position permitting movement of cables from said channel means through said entrance portion.

7 Claims, 5 Drawing Figures

VERSATILE GARMENT SECURITY DEVICE

FIELD OF THE INVENTION

The present invention relates to mechanical security systems and devices particularly adapted for providing protection against shoplifting of merchandise such as garments displayed on garment fixtures or racks. More specifically, the present invention provides a mechanical security system and mechanism which is of comparatively simplified construction and is characterized by novel features of construction and arrangement providing versatile adaptation to existing display racks and store fixtures and the like while permitting maximum accessibility to individual items of merchanise or apparel displayed on the racks or fixtures.

BACKGROUND OF THE INVENTION

Security devices are not new per se. A typical presently known system utilizes a single vinyl clad steel cable or chain threaded through a plurality of garments suspended on a store display fixture wherein the ends of the cable are secured by a locking mechanism to the fixture or rack. While this system is generally effective in securing the garments against theft, it nevertheless has certain disadvantages and drawbacks. For example, when a customer desires to select a given garment from the rack for "try on", it is necessary for the attendent sales personnel to unlock one end of the cable and release the selected garment by pulling the chain or cable through the other garments which are in the garment cluster until the garment under consideration is released for "try on". It has been found that this procedure is cumbersome and even potentially damaging to the merchanise and requires assistance of sales personnel even when customers are merely trying on the merchanise. Of course, each time a garment is removed, whether it is selected for purchase or not, it is necessary for the sales personnel to rethread the cable to secure the garments remaining on the rack or fixture and this is also time consuming. It is has also been observed that the entire process detracts from so-called impulse sales.

In accordance with a more recent security system, individual display items or garments are secured to a security mechanism mounted on the display fixture or rack by means of individual cables connected at one end to the display merchandise and at its opposite end detachably locked to the security mechanism. These security mechanisms are key-operated to permit release of the cables from the security device. Typically, one end of each of the cables is fitted with an enlarged spherical locking element which engages in a single elongated key-hole slot in the security device and normally locked therein by means of a key-operated mechanism within the security device. Thus the cables are locked in a single-file array and while the system allows greater flexibility for "try-on" purposes, it does not provide flexibility for disengaging any one of the cables individually from the locking device unless it is the first one in the array adjacent the release key-hole portion of the slot. For example, to remove a garment attached by a cable at the bottom-most position in the cable retention slot of the security mechanism requires removal and replacement of all of the cables ahead of it in its path. Thus, while this system is an improvement over the prior system first discussed above, it is also cumbersome to use and time consuming for store personnel.

SUMMARY OF THE INVENTION

The present invention provides a mechanical security system and device having novel features of construction and arrangement obviating the disadvantages of prior mechanical security systems and devices. To this end, the present security system and device includes a cable retention housing provided with a plurality of retention slots and novel locking mechanism so arranged as to afford release, removal and replacement of any single garment secured in a single security device without disturbing or removing retention cables affixed to other garments in the display cluster.

Accordingly, it is an object of this invention to provide a universal merchandise security system and device having greater cable retention capacity combined with the ability to release, remove and replace individual retention cables without disturbing or removing other retention cables in the security device.

Another object of the present invention is to provide a mechanical security system and device which will allow customer "try-on" without the necessity for disengaging the security means.

Yet another object of the present invention is to provide an improved mechanical security system and device that can be mounted to a variety of standard garment and merchandise store fixtures, tailored to fit a specific store fixture, or mounted to a wall.

Still another object of the present invention is to provide an inexpensive and easily manufacturable mechanical security device.

BRIEF DESCRIPTION OF THE DRAWINGS

These and other objects of the present invention and the various features and details of the operation and construction thereof are hereinafter more fully set forth with reference to the accompanying drawings wherein;

FIG. 1 is a perspective view of a security system and device in accordance with the present invention showing the security device mounted on the upright stanchion of a display rack or the like;

DESCRIPTION OF THE PREFERRED EMBODIMENT

Figure 1:
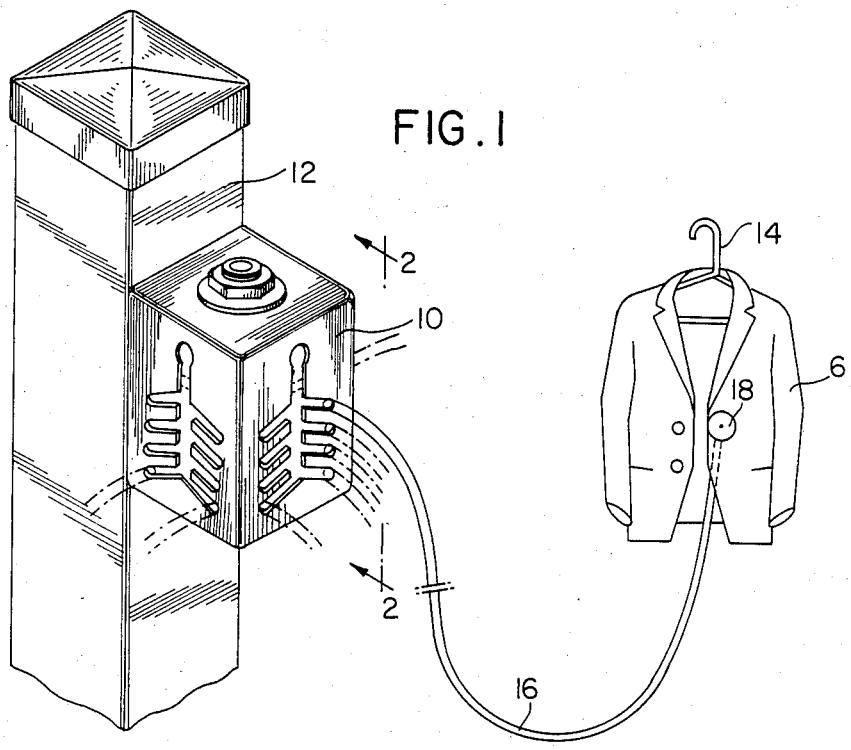
Figure 2:
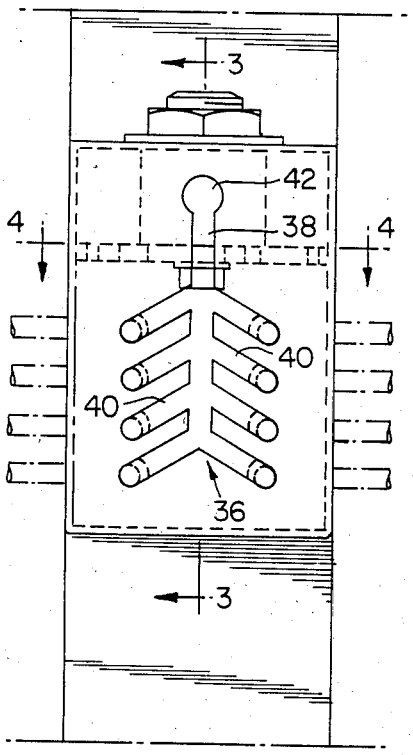
FIG. 2 is an enlarged view of the security device taken on lines 2—2 of FIG. 1.

Referring now to the drawings and particularly to FIG. 1 thereof, there is illustrated a security device generally designated by the numeral 10 mounted on the upright stanchion 12 of a display fixture or rack which has the customary hang-arms (not shown) projecting from the stanchion 12 on which garments G are mounted by hangers 14 for display purposes. As illustrated, each garment is normally locked to the security device 10 by means of an elongated cable 16 secured at one end through an opening such as a buttonhole in the garment by means of an enlarged plastic button 18 and at its opposite end mounts an enlarged spherical locking element 20 by which the cable is secured in the security mechanism 10 in a manner described in more detail below.

Considering the structural details and arrangement of the security device 10, the device comprises a housing 22 preferably made of metal such as steel which in the illustrated embodiment is of a hollow rectangular box-like configuration comprising four generally rectangular side panels 26, and top and bottom closures 28, 30 respectively. As illustrated, the security device 10 is mounted flush against the stanchion 12 of a support rack by suitable bolts or screw-type fasteners 32.

In accordance with the present invention, the security device 10 includes cable retention and release means characterized by novel features of construction and arrangement which provides protection against shoplifters and at the same time provides easy release and accessibility to a single selected individual article of merchandise. To this end, in the present instance, each of the rectangular sides of the housing 22 has cable retention and release channel or slot means formed therein generally designated by the numeral 36 which is of a Christmas-tree like configuration comprising an elongated vertical stem or manifold channel 38 and a plurality of downwardly diverging branch channels 40 extending from opposite sides of the central manifold channel 38. The upper end or tip of the central manifold channel has an enlarged key hole or entrance portion 42 of generally circular cross section. The cross sectional dimension D of the manifold channel 38 and branch channels 40 is preferably slightly greater than the diameter D1 of the cable and less than the diameter D2 of the spherical locking ball end 20 of the cable and the key hole slot 38 is of a diameter slightly greater than the diameter D1 of the locking ball end 20 of the cable to permit insertion and removal of cables to the cable retention or release channels 38, 40 through the key hole slot 42 in the manner described in more detail below.

An important feature of the present invention is the configuration of the downwardly inclined cable retention branch channels 38 which prevent the cables from unintentionally sliding into the manifold channel and maintain the manifold channel free for ease of removing a selected cable without disturbing the others. To engage the cables in the security device, the ball end 20 of the retention cable 16 is simply passed through the key hole opening 42 and positioned in a branch channel via the manifold channel. To disengage a selected cable, the process is simply reversed.

Figure 3:
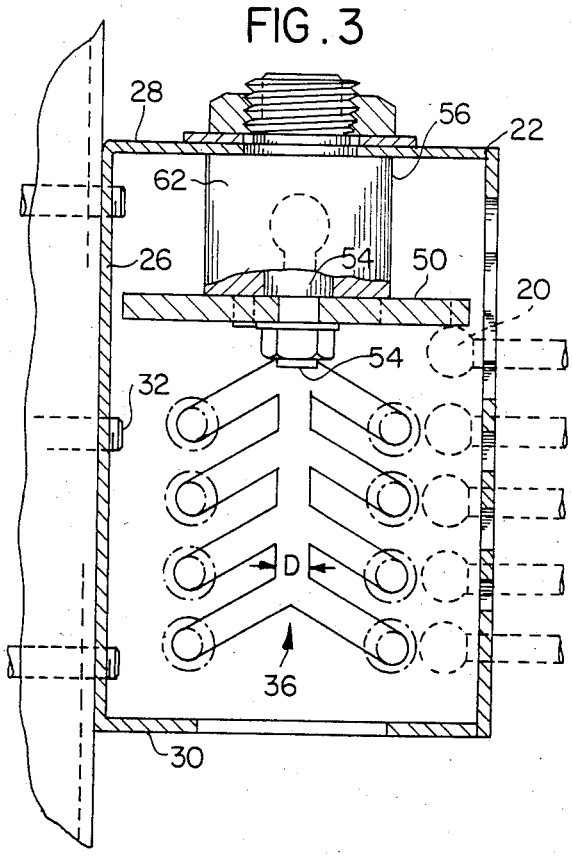
FIGS. 3 and 4 are enlarged sectional views taken on lines 3—3 and 4—4 respectively of FIG. 2.
Figure 4:
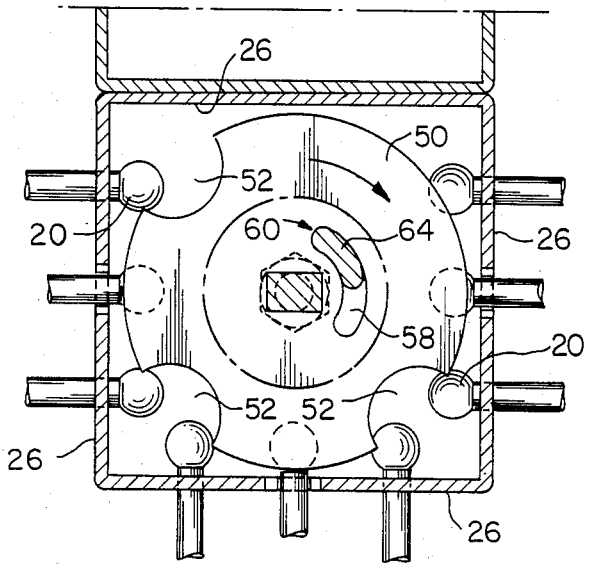
Figure 5:
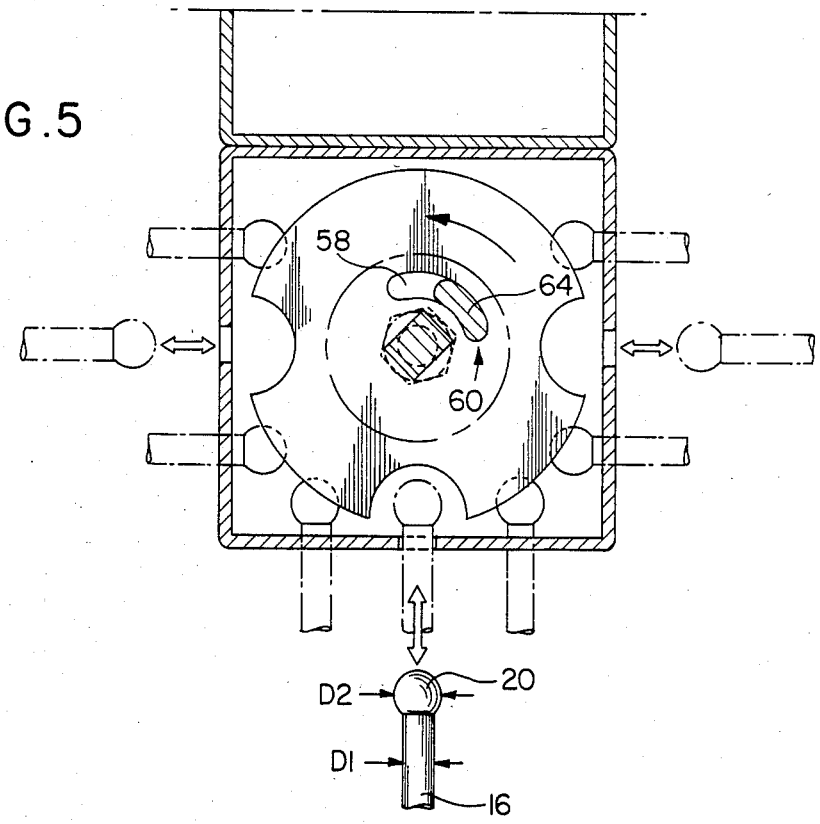
FIG. 5 is a view similar to FIG. 4 showing the control cam in a release position permitting release of a selected security cable for one of the garments.

The security device also includes means for locking the cables to the security device comprising, in the present instance, a circular cam element 50 having circumferentially spaced arcuate cut out portions 52 about its periphery as illustrated in FIGS. 4 and 5. The cam 50 is selectively rotatable between a locked position (FIG. 4) wherein the peripheral edge of the cam overlies the manifold or channel 40 and a release position where the arcuate cut out portions 52 are aligned with the manifold channel 40. As illustrated in FIG. 3, the cam is located in a predetermined vertical position in the housing below the enalrged key hole entrance portion 42 of the cable retention and release channel and secured to the shaft 54 of a key operated lock 56 mounted in the top wall of the security housing 10. The cam 50, as illustrated in FIGS. 4 and 5, has an arcuate slot 58 formed therein to receive a pin 60 mounted on the lock housing 62 (shown in FIG. 3) to control rotation of the cam 50 between the locked and release positions described above upon actuation of a key (not shown). More specifically, a tab 64 defining a cam follower projects from the lock housing 62 and engages in the arcuate slot 58 formed in the cam plate. Further, the key housing is locked in a fixed position in the top wall of the security device housing 22. In operation, therefore, when the key is inserted in the lock and rotated, the lock shaft 54 which, as illustrated in FIG. 3, is secured to the cam 50, rotates the cam 50 between the locked and release positions indicated in FIGS. 4 and 5 respectively. The tab cam follower 64 serves to limit rotation of the cam 50 to assure alignment of the arcuate cut outs 52 in the cam plate with the manifold channel 40.

Consider now use and operation of the system. As noted above, a single cable 16 is attached to each of the garments to be displayed at one end via the button 18 or other suitable means. With the key operated cam plate 50 in the release position shown in FIG. 5, the ball locking end of each of the cables is inserted through the enlarged entrance opening of the cable retention and release channel and slid into a selected one of the branch channels. When all of the garments on the display rack have been secured in this fashion, the cam plate is rotated by means of the key operated lock to the position shown in FIG. 4 so that all the cables are in a locked, secure position. Now when it is desired to remove a selected garment, the lock is simply actuated to rotate the cam plate to the position shown in FIG. 5. Thereafter, the locking ball end of the cable for the selected garment is simply moved from its location in a branch channel to the central manifold channel and removed through the key hole slot without the need for removing the cables for any of the other garments. Thus, the present invention provides a quick and easy means for removing a selected garment from the security device.

Even though the illustrated form of the security device is a box-like configuration, shapes other than polygonally shaped devices are possible within the scope of the present invention. For example, the housing can be of tubular cylindrical shape.

What is claimed is:

1. A system for securing display items to a fixture or the like comprising a housing adapted to be secured to the fixture, a plurality of elongated cables for securing the display items to the fixture, each cable having means at one end securing it to the display item and detachably secured in the housing at its opposite end, means defining cable retention and release channel means in said housing for a plurality of said cables, said channel means having an enlarged entrance portion and being of a configuration including a manifold channel and at least two branch channels disposed angularly relative to said manifold channel, to permit insertion and removal of said opposite end of any one of said cables whereby any one of said cables may be inserted or removed individually and locking means actuatable between a position blocking said entrance portion of said channel means and a second position permitting movement of cables from said channel means through said entrance portion, said cable retention and release channel means comprising at least one elongated manifold channel of predetermined cross section having a series of pairs of brahcn channels of similar cross section emanating from said manifold channel and an entrance slot portion at one end of said manifold channel of greater cross sectional opening than said manifold channel, and wherein said cable is of predetermined cross section less than the channels and the cable securing means at said opposite end is of said greater cross section than said channels and of a cross section to permit insertion and removal through said entrance slot portion.

2. A system as claimed in claim 1, wherein said cable retention and release channel means is of Christimas-tree configuration comprising an elongated central stem portion and downwardly divergent branch channel portions extending on opposite sides of said central stem portion and wherein the upper tip of said central stem channel portion is of circular cross sectional shape having a diameter slightly greater than the diameter of the spherical locking element at said opposite end of the cable.

3. A system as claimed in claim 1, including key operated latch or locking means mounted in said housing and a cam member operatively associated therewith operable between a position permitting assembly and removal of cable means into said cable retention channel means and a position blocking assembling of said cables therein.

4. A system as claimed in claim 1, wherein said housing is of polygonal configuration, defining a plurality of panels each of said panels having a cable retention channel means formed therein.

5. A system as claimed in claim 4, said housing including a bottom wall, means defining a central opening in the bottom wall of said housing providing access to the interior of said housing for assembling and disassembling said cam and key actuating means.

6. A system as claimed in claim 4, wherein said cam member is of generally circular configuration and is of an outer diameter closely adjacent the inner wall of said housing and having at least one recess in the periphery thereof, said recess alignable with said cable retention channel means to permit assembly and disassembly of cables therein and a position wherein the outer periphery of the disk lies closely adjacent the channel means to block assembly and disassembly of cables.

7. A system for securing display items to a fixture or the like comprising a housing adapted to be secured to the fixture, a plurality of elongated cables for securing the display items to the fixture, each cable having means at one end securing it to the display item and detachably secured in the hosuing at its opposite end, means defining cable retention and release channel means in said housing for a plurality of said cables, said channel means having an enlarged entrance portion and being of a configuration including a manifold channel and at least two branch channels disposed at an angle to a plane extending transversely to said manifold channel to permit insertion and removal of said opposite end of any one of said cables whereby any one of said cables may be inserted or removed individually and locking means actuatable between a position blocking said entrance portion of said channel means and a second position permitting movement of cables from said channel means through said entrance portion.

* * * * *